United States Patent [19]

Hofmann

[11] 4,124,191

[45] Nov. 7, 1978

[54] VEHICLE ELEVATING PLATFORM

[75] Inventor: Dionys Hofmann, Darmstadt-Marienhöhe, Fed. Rep. of Germany

[73] Assignee: Gebr. Hofmann GmbH & Co., Maschinenfabrik, Darmstadt, Fed. Rep. of Germany

[21] Appl. No.: 864,723

[22] Filed: Dec. 27, 1977

[30] Foreign Application Priority Data

Feb. 2, 1977 [DE] Fed. Rep. of Germany ..... 2704263

[51] Int. Cl.[2] ..... B66F 7/14

[52] U.S. Cl. ..... 254/89 R

[58] Field of Search ..... 254/89 R

[56] References Cited

U.S. PATENT DOCUMENTS

| | | | |
|---|---|---|---|
| 3,554,491 | 11/1968 | Tegtmeier | 254/89 R |
| 3,958,664 | 5/1976 | Perkins | 254/89 R |

*Primary Examiner*—Robert C. Watson

*Attorney, Agent, or Firm*—Cushman, Darby & Cushman

[57] ABSTRACT

A two-pillar, above floor elevating platform for vehicles having lift trucks disposed in each of the two pillars respectively. A three-phase AC motor in each pillar drives each lift truck vertically along the pillar. Apparatus which synchronizes the movement of the two lift trucks is located in a base platform upon which the two pillars are mounted. One of the motors may be disconnected when the torque necessary to lift the vehicle can be developed by the other motor. A one-phase to three-phase converter may be used to power the vehicle elevating platform in areas where only one-phase power is available.

3 Claims, 2 Drawing Figures

VEHICLE ELEVATING PLATFORM

The present invention relates to a two-pillar, above floor level vehicle elevating platform, and more particularly to such an elevating platform having a motor in each of the two pillars.

German Patent Application No. P 2,130,653 discloses a two-pillar, above floor level vehicle lifting platform, having a three-phase AC motor on one of the pillars, which produces the torque required for lifting or lowering the vehicles. The lifting device on the other pillar is driven by means of a chain drive located in the base frame upon which the two pillars are supported. The chain drive also synchronizes the motion of the lifting elements attached to each pillar. However, the use of the invention in the above-cited application requires the availability of a three-phase power supply. In addition, the large motor required to drive the lifting elements on each pillar severely reduces the space between the two pillars, or to compensate, the lifting platform has to be unnecessarily large.

The present invention overcomes these difficulties. A three-phase AC motor is placed in each pillar so that the two motors work together to provide the torque necessary to lift a vehicle. In the case of a lighter vehicle, a switch is provided for disconnecting one of the motors from the power supply so that the other motor drives the lifting elements on both pillars. As a result of the two motor arrangement, the apparatus needed to synchronize the movement of the two lifting elements has only half of the torque applied to it as compared to the prior art, so that the synchronization mechanism in the present invention may be designed more simply, resulting in a considerable cost savings. In addition, the use of two motors permits more free space between the pillars without increasing the overall width of the lifting platform.

The present invention also provides a one-phase to three-phase converter to power the three-phase motors. This permits the present invention to be used in areas where a three-phase power supply is not available.

These and other objects and advantages of the invention will become more apparent and more readily appreciated from the following detailed description of the presently preferred exemplary embodiment of the invention taken in conjunction with the accompanying drawings, of which:

Figure 1:
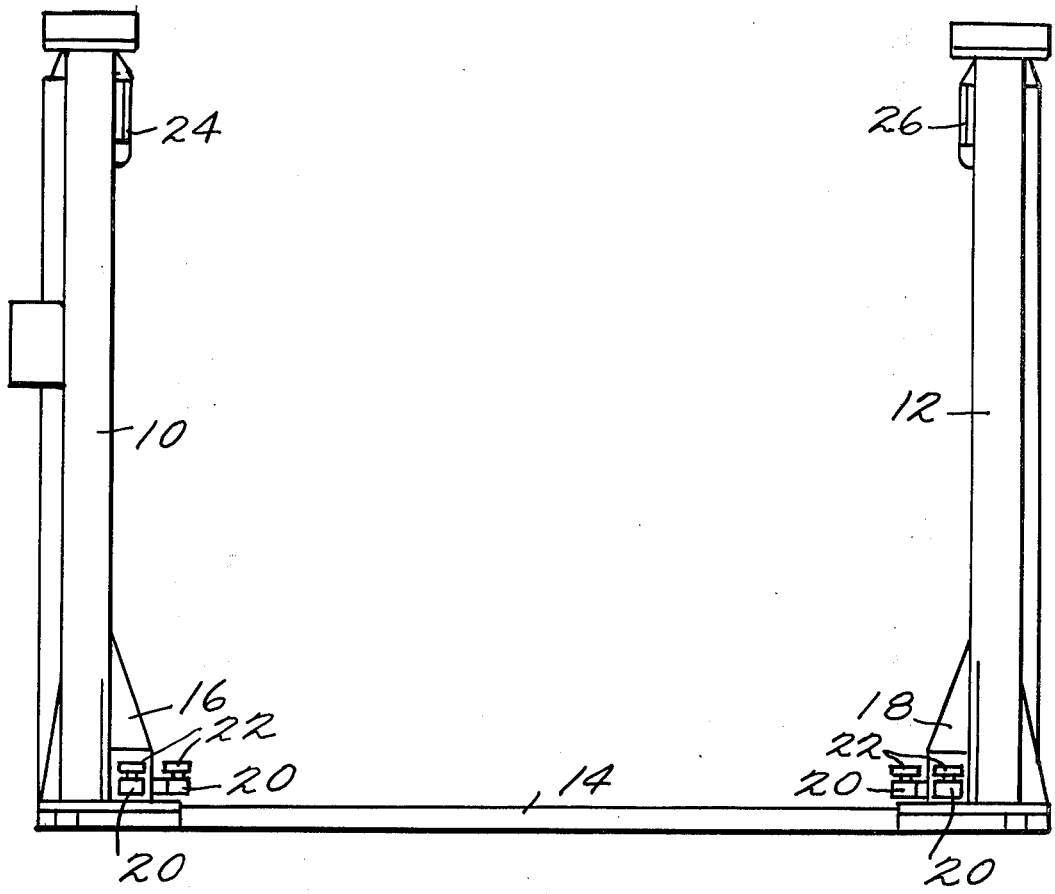
FIG. 1 is a schematic view of the present invention.

Referring first to FIG. 1, pillars 10 and 12 are attached to base frame 14. Lift trucks 16 and 18 are slidably attached to pillars 10 and 12 respectively, and are driven vertically along pillars 10 and 12 by screws (not shown) within pillars 10 and 12 in a conventional manner. Swivelable and extendable arms 20 are attached to each lift truck 16 and 18 and have supports 22 attached to the opposite end. A chain (not shown) within base 14 connects the screws in pillars 10 and 12 in order to synchronize the movement of lift trucks 16 and 18. Three-phase AC motors 24 and 26 respectively attached to pillars 10 and 12 drive the screws within pillars 10 and 12 by any suitable means such as V belts.

Figure 2:
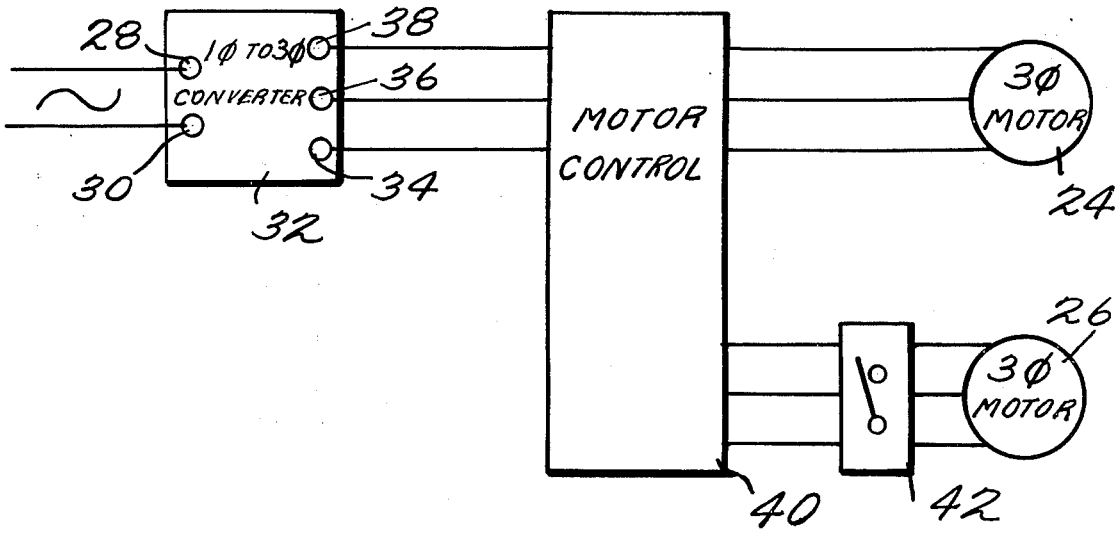
FIG. 2 is a block diagram of the main circuit of the present invention.

Referring now to FIG. 2, a single phase power supply is connected to terminals 28 and 30 of one-phase to three-phase converter 32. Converter 32 may be any such converter, but in the preferred embodiment includes a Steinmetz circuit, well known in the art. The output of converter 32 at terminals 34, 36 and 38 is directed to motor control 40 which supplies the power for three-phase AC motors 24 and 26. Switch 42 is positioned between motor control 40 and motor 26 so that motor 26 may be shut off during the operation of the lift.

In operation, the vehicle to be lifted is driven between pillars 10 and 12. Supports 22 are positioned beneath the appropriate points of the frame of the vehicle so that the vehicle will be safely supported upon the upward movement of lift trucks 16 and 18. Motor control 40 then supplies power to motors 24 and 26, which in turn drive the screws within pillars 10 and 12, raising lift trucks 16 and 18, respectively. If the vehicle is light, switch 42 may be opened so that motor 24 through the synchronization chain in base frame 14 drives the screws in both pillars 10 and 12.

As a result of the simple parallel switching of the three-phase AC motors 24 and 26, the switchover to a three-phase power source is easily accomplished. The three-phase source may be connected directly to terminals 34, 36 and 38.

As a result of the arrangement of the invention, the torque necessary for lifting heavy vehicles will be produced despite the single-phase power source without having to forego the advantages of a lifting platform having small dimensions. Furthermore, the present invention is easily adapted to lifting platforms as disclosed in the prior art having only one motor, by simply mounting a second motor on the second pillar and connecting the second motor to the screw of the second pillar by any appropriate method.

Although only one exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention as defined by the following claims.

What is claimed is:

1. A vehicle elevating platform comprising:

a base frame;

two pillars attached to said base frame;

two lift trucks, each respectively slidably attached to one of said pillars for supporting said vehicle;

motivating means within each of said pillars for sliding said lift trucks along said pillars;

means for synchronizing the movement of said lift trucks, said synchronizing means located within said base frame;

two three-phase AC motors, each respectively attached to one of said pillars, connected to said motivating means;

a power supply connected to said motors; and switch means for disconnecting one of said motors from said power supply when the torque necessary to lift said vehicle is capable of being developed in the other of said motors.

2. Apparatus as in claim 1 wherein:

said power supply produces one phase current; and said apparatus further comprises a one-phase to three-phase converter, having an input connected to said power supply and having an output connected to said motors.

3. Apparatus as in claim 1 wherein:

said apparatus further comprises a motor control means for dividing the output of said power supply and providing current to said motors; and said switch means is positioned between said motor control means and said one of said motors.

* * * * *